United States Patent [19]

Pearson

[11] Patent Number: 4,795,149

[45] Date of Patent: Jan. 3, 1989

[54] LUNGE TRAINING MACHINE FOR BODY BUILDERS

[76] Inventor: Bruce E. Pearson, 409 W. Woodruff, Apt. 1, Searcy, Ark. 72143

[21] Appl. No.: 143,563

[22] Filed: Jan. 13, 1988

[51] Int. Cl.[4] ..... A63B 21/06; A63B 21/00

[52] U.S. Cl. ..... 272/117; 272/118; 272/134

[58] Field of Search ..... 272/118, 93, 96, 117, 272/72, 116, 143, DIG. 4, 123, 70

[56] References Cited

U.S. PATENT DOCUMENTS

| | | | |
|---|---|---|---|
| 3,235,255 | 2/1966 | Leflar | 272/123 |
| 3,866,914 | 2/1975 | Jackson | 272/117 |
| 4,527,797 | 7/1985 | Slade, Jr. et al. | 272/118 |

FOREIGN PATENT DOCUMENTS

| | | | |
|---|---|---|---|
| 2052274 | 1/1981 | United Kingdom | 272/118 |

*Primary Examiner*—Richard J. Apley
*Assistant Examiner*—S. R. Crow
*Attorney, Agent, or Firm*—Stephen D. Carver

[57] ABSTRACT

An exercising machine for body builders or other athletes which facilitates the practice of squats, lunges, and similar lower body exercises, and encourages proper form as well as safety. A rigid steel frame of generally cubical dimensions, which rests upon a flat surface such as a floor, comprises upper and lower pairs of rigid, spaced apart rails. Vertical stanchions forming corners of the frame interconnect the upper and lower pairs of rails. A carriage assembly slidably disposed within the frame includes a pair of rigid, spaced-apart tracking side members which extend vertically between the upper and lower frame rails. A roller system at the bottom of the tracked side members enable it to roll on the lower rails, and similar wheels are employed at the top of the side members to track along the upper rails. During movement of the carriage operative alignment is preserved by telescoped compensation means which synchronize the track side members to prevent a bind or other inappropriate misadjustment during stressed carriage travel. A weight bar system extending between carriage sides may be loaded as desired by the bodybuilder. A padded, yoke-like collar associated with the weight bar harnesses the exerciser to the machine. Guide rods associated with each side member establish a vertical path for defining upward and downward movement, and weight bar sleeves coaxially mated to the guide rods enable vertical movements. The weight bar is pivotally mounted to the sleeves to facilitate its rotation to accommodate different exerciser movement and positions.

14 Claims, 4 Drawing Sheets

LUNGE TRAINING MACHINE FOR BODY BUILDERS

BACKGROUND OF THE INVENTION

The present invention relates generally to equipment for muscle conditioning, body building and the like. More particularly, the present invention relates to bodybuilding or weight training machines for the practice of lunges, squats and the like.

In recent years bodybuilding has become extremely popular with both athletes and other physical fitness enthusiasts. While it has long been known to exercise and build up muscle tissue with bar bells or conventional weights, various machines have been proposed for controlled, power bodybuilding. Machines may aid an individual in practicing desired exercises and they are usually designed and adapted to encourage repetitions of a variety of desired body movements. It is the object of body building training to increasingly put greater loads on muscles by increasing both weight resistance and the number of repetitions which may be performed with particular machines or weights. As the athlete trains on the machine with the desired equipment his strength, endurance and speed will increase.

Thigh and hip training involves the exercise of various thigh muscles such as the quadriceps and the ham strings or leg biceps. It is also desirable to strengthen the adductor and abductor muscles in the inner and outer sides of the thighs respectively. Squat exercises are considered to be one of the best lower body exercises available. Squats strongly stress the quadriceps, the buttocks and lower back muscles. Significant secondary stress is also placed upon the ham strings, upper back and abdominal muscles. Squats are traditionally performed with a barbell balanced across the exercisers back. The legs are slowly bent until a squatting position is assumed.

Hack squats can be performed with traditional barbells, or with conventional hack machines which are relatively popular in modern gymnasiums. Hack squats particularly stress the quadriceps in relative isolation from the remainder of the exerciser's body. A conventional hack machine may include a yoke, which tensions the exerciser's shoulders as the knees are bent and the legs assume a squatting type position. Lunge exercises stress the quadriceps, buttocks and upper ham strings. The barbells are conventionally held much the same way as when performing a squat, but when the lunge position is assumed, one leg will be moved forward and the other leg will be moved rearward.

During bodybuilding exercising it is important to maintain proper kinetics of movement. Appropriate training also involves the emulation of proper form and ranges of movement. For example, where bending movements are involved it is important that the proper fulcrum position be realized by the athlete. Although it is normally possible to exercise one's muscles in a complete work out without using "machine" type devices, it has been found that properly designed exercising machines help encourage both the novice and experienced bodybuilder to observe proper form and routine.

Proper body building technique also require adherence to safety procedures. One important safety recommendation is that the athlete use "spotters" to stand near him when "free weights" such as barbells are being lifted. This is especially important in conjunction with bench press or squat exercises. It is also prudent to have some form of safety-catch rack or equipment so that heavy barbells cannot be dropped in response to a muscle cramp or the like. Machines adapted to "control" weights such as barbells are ideally adapted to promote these safety aspects. In other words, although it is known to perform squats, lunges, or power squats with loose barbells, it would be desirable to provide a system wherein lunges and power squats could be performed within a controlled environment with a machine which adds a degree of safety and stability, and promotes good form.

Therefore I have provided a machine which safely enables an exerciser to perform squats, lunges and the like and which simultaneously urges them to maintain proper form and a high degree of safety.

SUMMARY OF THE INVENTION

The present invention comprises a machine which enables exercisers, body builders or the like to practice squats, lunges, and similar leg exercises. The machine encourages users to adopt a proper form, and it safely enables and facilitates repetitions of exercise sets designed to strengthen the legs and lower body.

Preferably the machine comprises a rigid steel frame of generally cubical dimensions which is adapted to be disposed upon a flat supporting surface such as the floor of a gymnasium. The frame comprises a pair of parallel, spaced-apart, rigid rails which normally rest upon the floor, and a pair of similar, parallel upper rails. Vertically upwardly extending stanchions extend between the pairs of rails at each corner of the machine. The interior of the frame is accessible to the exerciser, who may enter the machine through the back of the frame.

A carriage assembly slidably supported by the frame is moved by the exerciser. The carriage assembly includes a pair of rigid, spaced-apart tracking side members which extend vertically between the upper and lower frame rails. A roller system at the bottom of the tracked side members enable it to roll on the lower rails, and similar wheels are employed at the top of the side members to track along the upper rails. During movement of the carriage operative alignment is preserved by compensation means which synchronize the track side members to prevent a bind or other inappropriate misadjustment.

A weight bar system extends between the tracking side members of the carriage assembly. The weight bar ends may be loaded as desired by the bodybuilder to achieve the desired stress level. A yoke-like collar associated with the weight bar means engages the neck and shoulders of the exerciser. Pads are preferably associated with the collar for comfort. The collar thus harnesses the exerciser to the weight bar system, which in turn couples the exerciser to the carriage.

A pair of guide rods associated with each side member establish a vertical path for defining upward and downward weight bar movement. The weight bar system includes a pair of sleeves, including linear bearings for mounting the weight bar to the guide rods for axial movement. A substantially horizontal portion of the weight bar is mounted to the sleeves with suitable pillow blocks to facilitate weight bar rotation to accommodate different exerciser movement and positions. The collar is firmly forced down upon the shoulders of the user by offsets at the end of the weight bar which create a wait moment to properly load the exerciser.

Handle operated support means may be moved inward or outward of proper position to temporarily hold the weight bar to facilitate user ingress or egress from the machine. Additionally, a locking mechanism is optionally provided to at least temporarily secure the carriage in an entry position at the rear of the frame. The support system preferably includes a pair of rods equipped with stop members which are turned into position by suitable handles.

Thus a basic object of the present invention is to provide a machine for enabling an exerciser to perform weighted squats, lunges, calf raises, good mornings, power squats and the like.

Another basic object of the present invention is to provide an exercising machine of the character described which safely distributes and controls the weight load.

Another basic object is to provide an exercise machine as described which encourages proper form.

A still further object is to provide a bodybuilding machine of the character described which is ideal for use by bodybuilders in conditioning their lower body.

Yet another object of the present invention is to provide a weight training system of the character described wherein the weights are not free to fall past a set point.

A fundamental object of the present invention is to provide an exercising machine of the character described which combines forward and rearward body movement along with upward and downward weight movement.

A related object is to provide a weight exercising machine of the character described which facilitates both muscle isolation and stress intensification.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
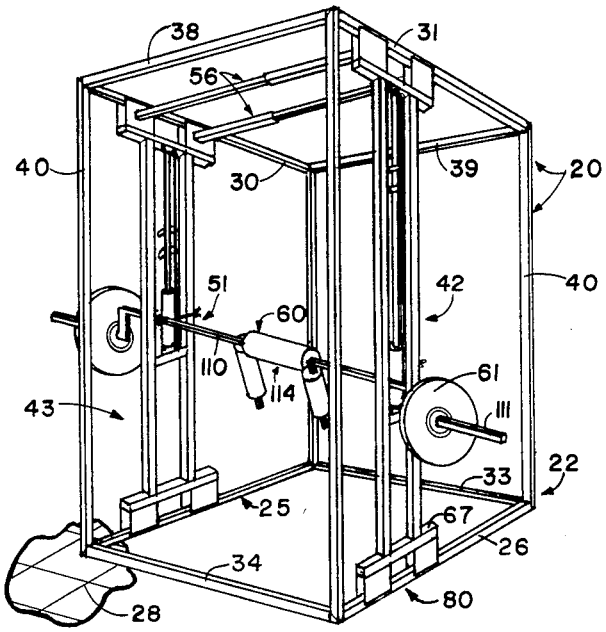
FIG. 1 is a fragmentary, isometric view showing my Lunge Training Machine for Bodybuilders with the weight bar and carriage assemblies substantially disposed in an entry position.
Figure 2:
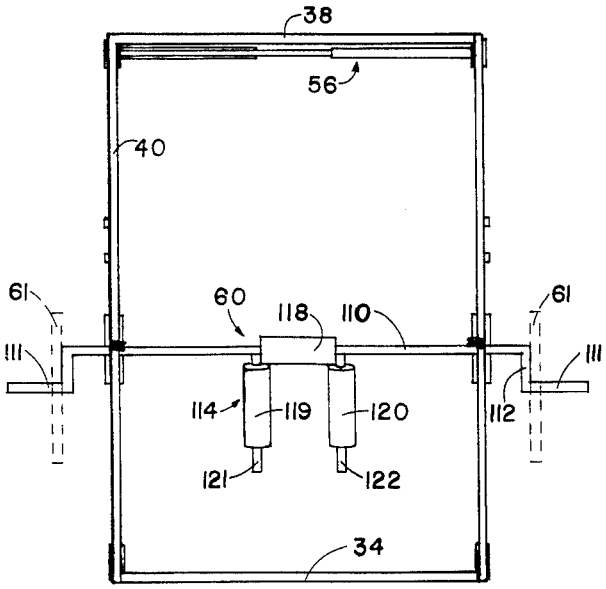
FIG. 2 is a plan view of the machine of FIG. 1.
Figure 3:
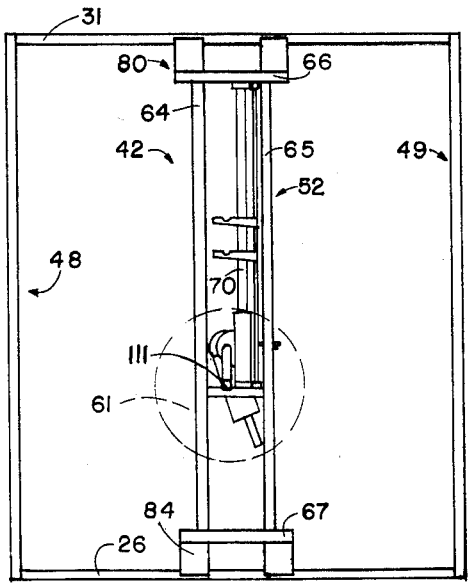
FIG. 3 is a side elevational view thereof, with the carriage shown in a displaced position.

With initial reference now directed to FIG. 1 of the appended drawings, a lunge training machine constructed in accordance with the best mode of the present invention has been generally designated by the reference numeral 20. Machine 20 includes a generally cubical frame broadly designated by the reference numeral 22, which includes a pair of lower rails 25 and 26 which are parallel to and spaced-apart from a similar pair of upper rails 30 and 31. Front and rear cross pieces 33 and 34 respectively brace and align the lower rails 25 and 26, thereby forming a bottom of the frame. The frame is adapted to be disposed upon a flat supporting surface such as floor 28 of the gymnasium. Upper rails 30 and 31 are similarly braced by cross pieces 38 and 39. A plurality of rigid, generally vertically extending stanchions 40 form the corners of the frame and extend from the bottom rail members 25 and 26 to the upper rail members 30 and 31.

With additional reference directed now to FIGS. 2 through 6, a movable carriage assembly is generally indicated by the reference numeral 42. The carriage assembly is received within the interior 43 of the frame, and it is adapted to be moved by an exerciser 44 during weight training. Specifically, the carriage assembly may roll from the rear 48 towards the front 49 of the frame. A weight bar assembly, generally designated by the reference numeral 60, extends transversely between the carriage assembly sides, and it is adapted to receive a plurality of suitable conventional weights 61 so a desired load may be assumed. The weight bar assembly 60 is free to move either upwardly or downwardly relative to the carriage, as will hereinafter be described in more detail.

The carriage assembly comprises first and second sides, broadly designated by the reference numerals 51 and 52, which are supported by suitable roller mechanisms to be later described which are associated with both the lower pair of rails and the upper pair of rails. During movement of the carriage assembly twisting or binding forces which might otherwise misalign the carriage are prevented or resisted by compensation means 56 which extend between the rollers at the tops of both upper carriage roller assemblies.

Figure 6:
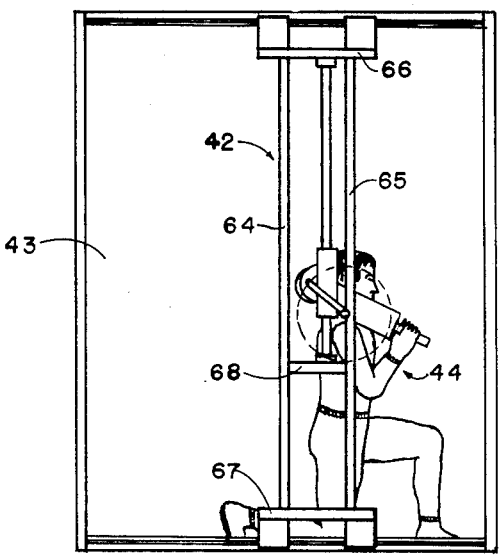
FIG. 6 is a fragmentary, side view similar to FIGS. 4 and 5, but illustrating a possible final lunge position.
Figure 4:
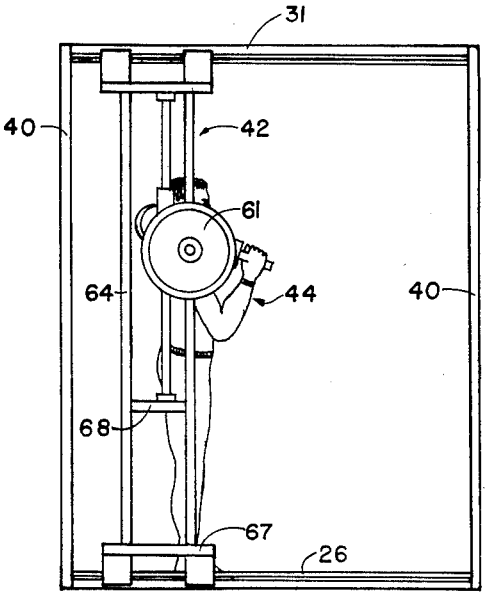
FIG. 4 is a fragmentary, side view illustrating an exerciser within the machine in an entry or "start" position.
Figure 7:
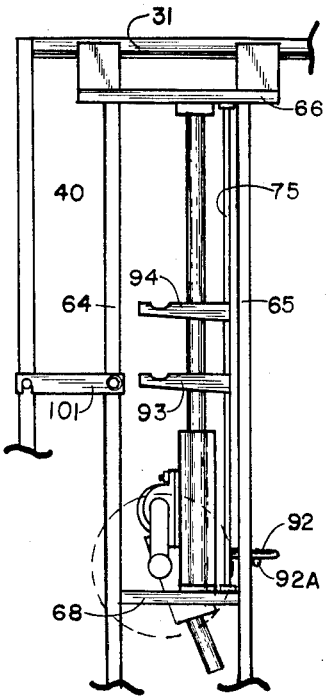
FIG. 7 is a fragmentary, side view of the machine illustrating the stop bar and locking mechanism.
Figure 8:
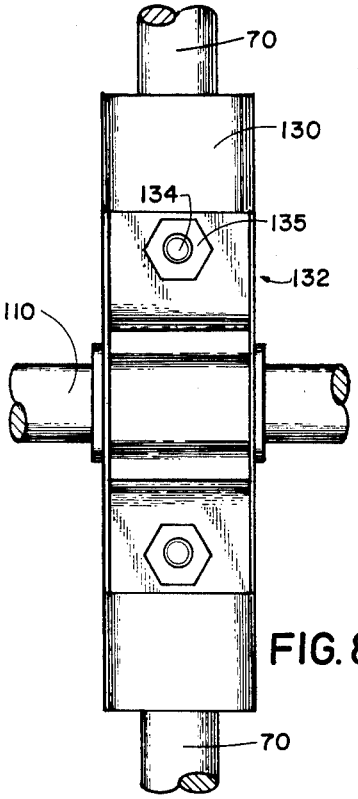
FIG. 8 is a fragmentary, enlarged scale plan view of a typical pillow block and sleeve construction for mounting the weight bar assembly.

As will be appreciated from a comparison of FIGS. 4 and 6, for example, the carriage may be rolled between the rear 48 and the front 49 of the frame. Each tracked side member 51 and 52 preferably includes a pair of spaced-apart, side stanchions 64, 65 which extend vertically between suitable terminal braces 66, 67. With additional reference directed now to FIGS. 10 and 11, a rigid, preferably cylindrical guide rod 70 extends between braces 68 and 66 in generally parallel, spaced-apart relation relative to stanchions 64, 65. These guide rod members 70 define a vertical travel path for the weight bar assembly 60, which, as hereinafter explained more fully, includes sleeve portions coaxially affixed to the members 70.

Figure 14:
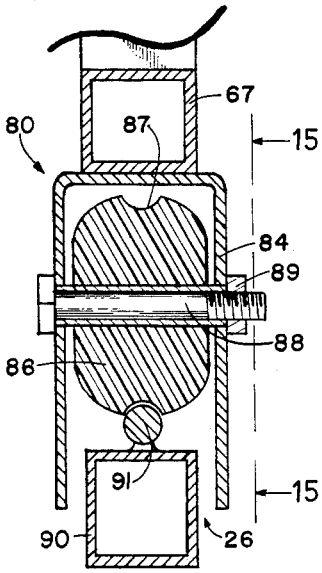
FIG. 14 is a fragmentary sectional view illustrating the preferred roller system of the carriage; and, FIG. 15 is a fragmentary view of the preferred carriage roller system, taken generally along line 15—15 of FIG. 14.
Figure 15:
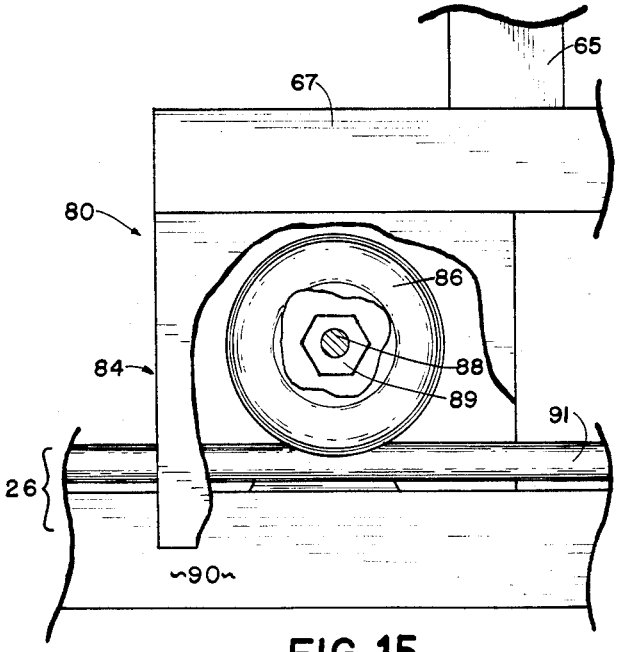

Turning additionally now to FIGS. 14 and 15, a preferred roller assembly has been generally designated by the reference numeral 80. A roller assembly 80 is disposed upon each end of both side member cross braces 67 and 66. Each includes a rigid, external channel member 84 which houses a suitable preferably metallic roller 86. A conventional bolt 88 extending across the sides of channel 84 secured by a nut 89 forms an axle for rotation. Preferably the rails such as rails 25, 26, 30 and 31 include a rigid, generally square cross section portion 90 to which an upper rigid, cylindrical rail member 91 is secured by welding or the like. A suitable circumferential notch 87 peripherally defined in the rollers 86 rides upon rail member 91. Although the rail system is preferably configured as shown in FIGS. 14 and 15 in the best mode, it would of course be possible to configure rollers 86 to properly dynamically engage support rails of differing geometry. Moreover, it should be appreciated that the rail and roller construction discussed in conjunction with FIGS. 14 and 15 is employed at each end of both support braces 67 and 66 in conjunction with both carriage sides, both at their tops and at their bottoms.

Figure 12:
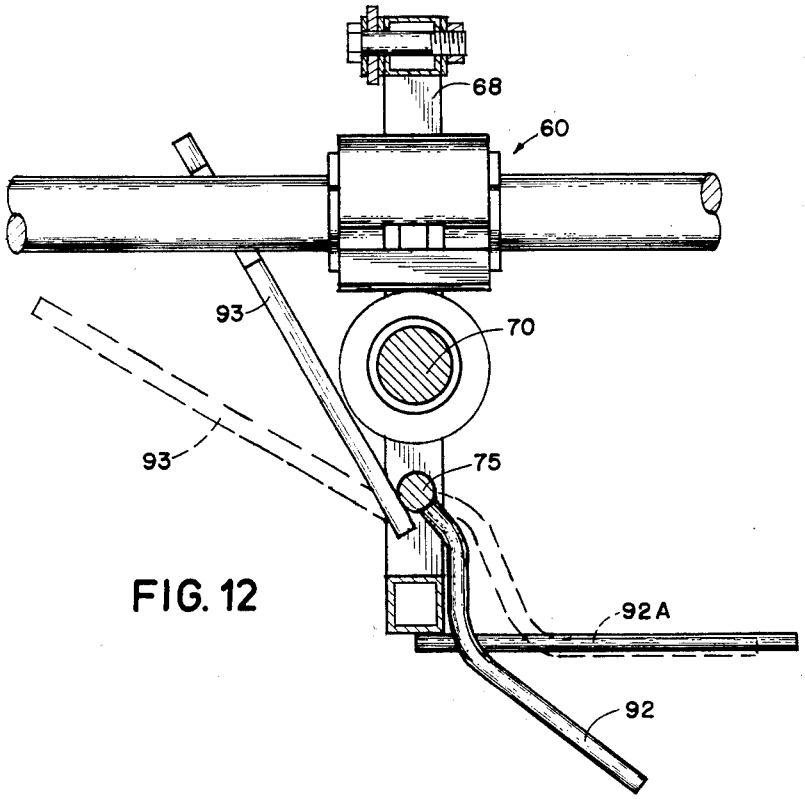
FIG. 12 is a fragmentary, diagrammatic view illustrating how the stop bar assembly is turned into position.

Each carriage side member additionally comprises a vertical support bar 75 which extends between braces 66 and 68 parallel with and spaced-apart from the sides 64 or 65. With reference to FIG. 12, the support bar 75 may be turned between positions illustrated therein by grasping handles 92 and 92A. When the handles 92 and 92A are squeezed together, the stop members 93 are moved relative to the weight bar means 60. Thus, for example, the position illustrated in solid lines in FIG. 12 provides a weight receptive support. A pair of stop bar members 93 and/or 94 may be employed to enable the weights to be positioned in a desired ingress or egress position, as additionally illustrated in FIG. 10.

Figure 5:
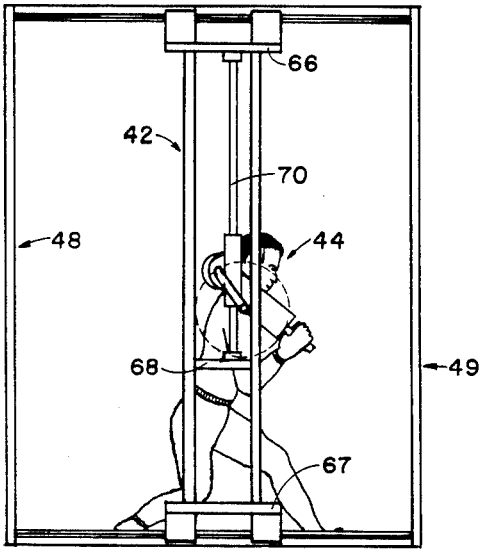
FIG. 5 is a fragmentary view illustrating a possible intermediate position assumed during a lunge exercise.
Figure 13:
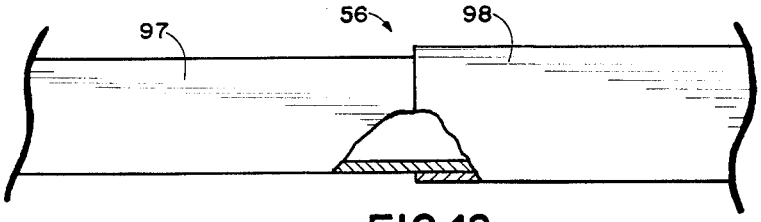
FIG. 13 is a fragmentary view illustrating a portion of the twist compensation means associated with the carriage.

As the carriage assembly moves inwardly or outwardly of the machine as illustrated in FIGS. 4–6, for example, the opposite sides thereof are synchronized or raised by the extension mechanism 56 (FIGS. 1 and 13). As seen in FIG. 1, synchronization is best achieved by employing a pair of off-set synchronization systems 56 at the top of the carriage. Each member 56 includes interfitting lengths of channeled steel 97, 98, which are telescopingly coupled together. For example, as illustrated in FIG. 13, it will be apparent that member 97 may be slidably co-axially received within companion 98. Relative axial movement of these two members may occur to compensate for twisting or binding forces which might otherwise bind the carriage.

Figure 10:
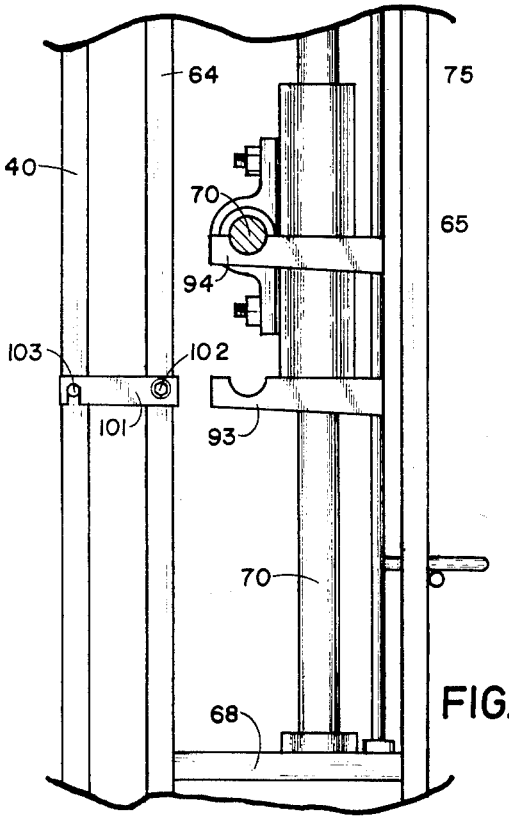
FIG. 10 is a fragmentary, side elevational view illustrating the weight bar assembly disposed on a suitable stop bar assembly.
Figure 11:
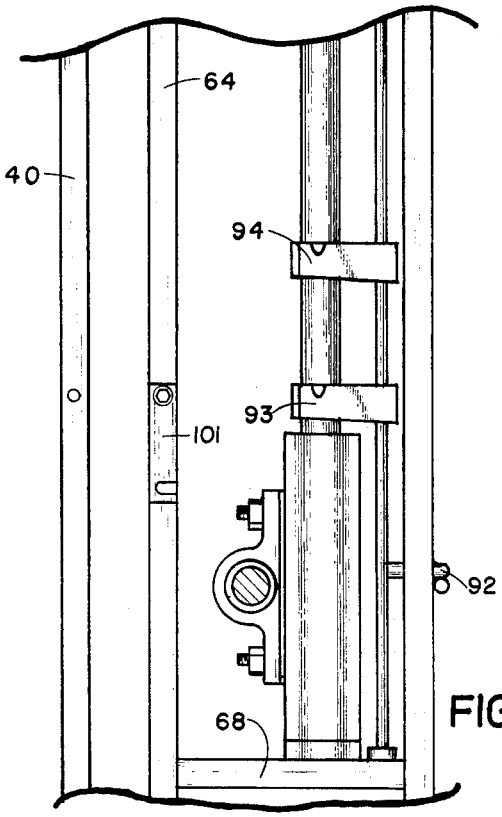
FIG. 11 is a fragmentary, side elevational view illustrating the carriage lock and stop bar assembly both in an unlocked position.

The carriage may be locked in place temporarily at the rear of the frame. Each carriage includes twin locking tabs 101 which are pivoted to its side members 64 at 102 and which are suitably notched so as to engage stops 103 projecting from the frame rear members 40. FIGS. 10 and 11 respectively reveal the carriage in a locked and unlocked position.

With primary reference now directed to FIGS. 1,2,8, 9 and 12, the weight bar assembly includes a rigid, horizontally extending rod 110 which extends generally transversely across and within the frame. It includes off-set rod end members 111 which are integral with but angularly spaced apart from main horizontal member 110 by off-sets 112. A central collar, generally designated by the reference numeral 114, includes a central cylindrical, sleeve like pad 118, and similar pads 119 and 120 respectively disposed over collar supports 121 and 122 which are welded to bar 110. This yoke-like collar 114 thus enables the user to harness himself to the machine as illustrated in FIGS. 4–6. As viewed in FIG. 1, for example, the off-set ends 111 are thus positioned so as to produce a downward moment upon the shoulders of the user in response to weights 61. The collar is thus dynamically coupled to the upper torso of the exerciser 44.

Figure 9:
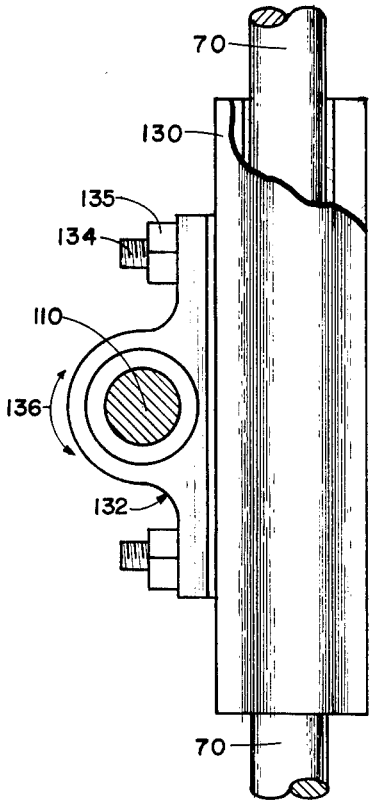
FIG. 9 is a fragmentary, side view of the pillow block and sleeve construction of FIG. 8.

The weight bar is coupled to the guide rods 70 at each of its ends though the combination of a linear bearing sleeve 130 which is coaxially captured upon the rod means and a conventional pillow block assembly 132. Sleeve 130 is adapted to linearly move upwardly or downwardly with respect to guide rods 70, to facilitate vertical displacements of the weights. The pillow block assemblies facilitate relative rotation between the weight bar means and the carriage. Pillow blocks 132 may be secured to conventional threaded studs 134 by nuts 135. The weight bar means and the weights are thus free to be rotated generally in direction of the arrow 136 (FIG. 9).

Thus once the locking system 101 is disengaged, an exerciser 44 may enter the frame and engage the collar as seen in FIG. 4. Suitable weights 61 may be added to both sides of the weight bar system so as to provide desired stress. The legs of the exerciser may be positioned substantially as shown or other leg bending exercises involved in the performance of lunges or squats may be assumed. As the exerciser lowers himself to a final position reached, for example, in FIG. 6, limited relative rotation of the weight bar assembly will occur contemporaneously with linear or downward displacement. As the weight bar assembly is thus rotated and displaced vertically, the carriage assembly will roll linearly within the frame. Unintentional bending or twisting movements which might otherwise cause the user to drop the weights are resisted both by the sleeve and pillow block mounting system described, and by the compensation system of FIG. 13. The foregoing notwithstanding, if the exerciser 44 inadvertently drops the weights, downward travel will be ultimately limited by the intermediate cross braces 68 (i.e. part of the carriage sides) to prevent injury.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A machine for use by an exerciser for muscle conditioning, body building, weight training, exercising and the like, said machine comprising:

a rigid frame adapted to be disposed upon a supporting surface such as the floor of a gymnasium or the like, said frame comprising front and back portions, lower rails resting upon said surface, upper rails disposed above said lower rails, said upper and lower rails extending between said front and said back portions and supportive stanchion means extending generally vertically between said upper and lower rails;

a carriage assembly adapted for selective horizontal movement relative to said frame, said carriage assembly comprising:

a pair of rigid, spaced apart, tracked side members operationally vertically extending between and engaging upper and lower rails for horizontal movement thereon;

compensation means telescopingly interconnected between said pair of tracked side members for synchronizing said side members to prevent said carriage assembly from binding within said frame;

weight bar means operatively extending between said tracked side members for supporting a desired load of weights, said weight bar means comprising collar means for harnessing said exerciser to said carriage assembly; and, mounting means for coupling said weight bar means to said side members to permit up-and-down movement of said weight bar means and thus said collar means relative to said carriage assembly and said frame; and, whereby said carriage means may move relative to said frame concurrently with movement of said weight bar means to facilitate the practice of weighted lunges and the like by said exerciser.

2. The machine as defined in claim 1 wherein said mounting means comprises guide rod means vertically associated with each side member for defining a vertical path which said weight bar means may axially travel.

3. The machine as defined in claim 2 wherein said weight bar means comprises sleeve means concentrically coupled to said guide rod means for axial movement with respect thereto, and bearing means coupled to said sleeve means for permitting relative rotation of said weight bar means.

4. The machine as defined in claim 3 wherein outermost opposite terminal ends of said weight bar means are offset from a longitudinal axis of said bar means so as to produce a moment in response to said desired load of weights disposed upon said weight bar means ends thereby firmly forcing said collar means toward the shoulders of said exerciser.

5. The machine as defined in claim 3 including means for locking said carriage assembly in a stationary position at the back of said frame.

6. The machine as defined in claim 3 including support means for resting said weight bar means to free said exerciser.

7. The machine as defined in claim 6 wherein said support means comprises a vertical bar associated with each tracked side members, said bar being spaced apart from said guide rod means in each tracked side members, each bar means comprising handle means and stop brace means adapted to be turned into position by said handle means to support said weight bar means.

8. A machine for use by a body builder, weight trainee, or other exerciser for body building, muscle conditioning, and the like, said machine comprising:

a rigid, substantially upright frame adapted to be disposed upon a supporting surface such as the floor of a gymnasium or the like, said frame comprising a lower pair of parallel spaced apart rails resting upon said surface, an upper pair of parallel, spaced-apart rails disposed above said lower pair, a plurality of supportive stanchions extending between said upper and lower pairs of rails, and a front and a back;

a carriage assembly coupled to said frame for selective horizontal movement relative thereto, said carriage assembly comprising:

a pair of rigid, spaced apart, wheeled side members extending between said upper and lower pairs of rails and adapted to roll generally axially with respect thereto;

weight bar means operatively extending between said side members for supporting a desired load of weights to be manipulated by said exerciser, said weight bar means comprising collar means for harnessing said exerciser to the weight load;

mounting means for coupling said weight bar means to said side members to permit up-and-down movement of said weight bar means and thus movement of said collar means relative to said carriage assembly and said frame;

whereby said carriage means may move horizontally relative to said frame concurrently with up and/or down vertical movement of said weight bar means to facilitate the practice of weighted lunges and the like by said exerciser.

9. The machine as defined in claim 8 wherein said carriage assembly comprises compensation means telescopingly interconnected between said pair of wheeled side members for synchronizing said side members to prevent said carriage assembly from binding within said frame.

10. The machine as defined in claim 9 wherein said mounting means comprises guide rod means vertically associated with each side member for defining a vertical path which said weight bar means may axially travel.

11. The machine as defined in claim 10 wherein said weight bar means comprises sleeve means concentrically coupled to said guide rod means for axial movement with respect thereto, and bearing means coupled to said sleeve means for permitting relative rotation of said weight bar means.

12. The machine as defined in claim 11 wherein the outermost ends of said weight bar means are offset from a longitudinal axis of said bar means so as to produce a moment in response to weights disposed upon said weight bar means ends firmly forcing said collar means toward the shoulders of the exerciser.

13. The machine as defined in claim 12 wherein said means for resting said weight bar means comprises an elongated vertical bar associated with each said wheeled side member, said bar being spaced apart from said guide rod in each side tracker, each bar means comprising handle means and stop brace means adapted to be twisted into position by said handle means to support said weight bar means.

14. The machine as defined in claim 13 including means for locking said carriage assembly in a stationary position at the back of said frame.

* * * * *